United States Patent [19]

Meek

[11] Patent Number: 4,953,728

[45] Date of Patent: Sep. 4, 1990

[54] TAMPER PROOF BOTTLE

[76] Inventor: John R. Meek, P.O. Box 622, R.R. 1, Crawfordsville, Ind. 47933

[21] Appl. No.: 279,862

[22] Filed: Dec. 5, 1988

[51] Int. Cl.[5] ..... B65D 41/00; B65D 39/00

[52] U.S. Cl. ..... 215/250; 215/330; 215/355; 220/254; 220/265; 220/307

[58] Field of Search ..... 215/250, 330, 355; 220/254, 265, 307; 4/144.1, 144.2

[56] References Cited

U.S. PATENT DOCUMENTS

| | | | |
|---|---|---|---|
| 3,083,858 | 4/1963 | Biedenstein | 220/265 |
| 3,088,617 | 5/1963 | Krautkramer | 215/250 |
| 3,187,966 | 6/1965 | Klygis | 222/541 |
| 4,261,474 | 4/1981 | Cohen | 215/250 |
| 4,456,136 | 6/1984 | Palsson | 215/216 |
| 4,458,820 | 7/1984 | Abrams | 215/230 |
| 4,534,477 | 8/1985 | Laub, III | 215/215 |
| 4,646,926 | 3/1987 | Agbay et al. | 215/203 |
| 4,736,859 | 4/1988 | Mayes et al. | 215/230 |
| 4,789,597 | 1/1989 | Mayes et al. | 215/250 |

*Primary Examiner*—Stephen Marcus
*Assistant Examiner*—Nova Stucker
*Attorney, Agent, or Firm*—Robert A. Spray

[57] ABSTRACT

A tamper-proof bottle for assuring a legal "chain of custody" of its contents. The bottle has adjacent its open end a circumferential series of abutment bodies, each of which co-operates with one of a series of abutment bodies carried on the inner wall of the cap's rim wall, forming a series of retainer sets. When rotated to its closed position, the cap and bottle cannot be separated without breakage; and in moving into that position, the resilient nature of the sets is sufficient to let the set bodies pass one another but after such passing to cause the deformable body portion to move so that at least a part of one will be within the axial extent of the abutment wall of the mating body portion, thus blocking against cap-removal except with breakage. The cap is also provided with one or more outlet ferrules, they being closed-ended cylinders; and a plug is provided for resealing the bottle once the closed end is cut off, the plug being self-locking once inserted.

25 Claims, 2 Drawing Sheets

TAMPER PROOF BOTTLE

FIELD OF THE INVENTION

The present invention relates to containers; and more particularly the concepts achieve a tamper-proof container such as for protection and non-contamination of the contents, as is desired to establish and prove a "chain of custody" and nonchanged purity of whatever is placed into the container, as regards legal factors of custody, substance-identity means of proof, etc., of specimens.

Body fluids, as for drug-testing and other screening purposes, are substances and procedures for which the tamper-proof containers would be particularly useful; so although the invention and its concepts are not limited to such a use, the invention will be described in such a use.

The matters of legal proof, and the legal conclusiveness of specimen testing, depend upon being able to show a "chain of custody" as to specimens being tested or screened; i.e., to show that a specimen is not all changed or altered during the procedure and time between being inserted into the bottle and the testing or laboratory analysis procedure, and further between the time the bottle is somehow opened for testing and its storage thereafter for whatever are the subsequent steps of re-testing and/or storage.

The tests as now known require that an opening of the bottle need be done, to withdraw or test a sample of the specimen, and thus the desire and goal has long been, and is, the provision of closure means which assure that the bottle cannot be opened; and the desire and goal includes similarly the requirement that the no-closure or re-sealing of the container after the test stage be such that opening will yield visual indication of the fact that the container has been opened. These are the characteristics of construction, concept, and operativity which the invention and its co-operating features provide and achieve.

SUMMARY OF THE INVENTION

According to the inventive concepts, in combination, there is provided a tamper-proof container assembly of a bottle and a cap, for better assuring a "chain of custody" legal proof or safekeeping of the contents, by a series of sets of abutment bodies on the bottle and the cap which provide that once the cap has been affixed to the bottle the cap is blocked from being removed without breakage of the bottle or the cap means; and means provide for the convenient assembly of the cap to the bottle even though blocking cap-removal to assure preservation of the contents.

Further, the concepts provide an accommodation for once-operable removability means, providing that even though the cap has been locked to the bottle, there may be an opening for the container means once such as for a test procedure; and a non-removable closure plug is provided to lockingly reseal the bottle and cap assembly, providing tamperproofness for that subsequent period after the single occasion of an opening for testing.

In short summary, the combination provides that a substance put into the bottle is preservably tamper-proof thereafter except on a single occasion; and any opening of the cap and bottle assembly other than as accommodated per the above will give a visual indication of unauthorized tampering.

PRIOR ART INSTALLATIONS DO NOT PROVIDE THE PARTICULAR ADVANTAGES AND CHARACTERISTICS HERE ACHIEVED

In considering the nature of the assembly and the cap-locking concepts, and contrasting the inventive nature of the present concepts over prior art containers as known to the inventor, it is not only conceded but emphasized that there are prior art bottle and cap assemblies which would and do quite effectively provide safeguards against unauthorized opening; and such safety containers have been and are in use by the millions, such as in so called "child proof" medicine bottles.

However, none of the container assemblies of the prior art, including any of current use known to the inventor, have economical cap-locking features such as provided by the present invention; and this is so, even though they have sets of co-operating lugs or abutments which have a superficial resemblance to features of the present invention. Yet, in spite of such resemblances, they fail to provide special and particular advantages of the present invention.

THE INVENTION'S COMPONENTS AND CONCEPTS ARE SIMILAR TO THOSE AVAILABLE IN THE PRIOR ART, EXCEPT FOR THE PRESENT CONCEPTS IN PARTICULAR, AND IN THESE COMBINATIONS

In a hindsight consideration of the present invention to determine its inventive and novel nature, it is not only conceded but emphasized that the prior art had details useable in this invention if the prior art had had the guidance of the present concepts and the conception of the combination of features of the overall invention.

That is, it is emphasized that the prior art had several particulars:

a. The prior art had a co-operating series of abutment lug features in "child-proof" bottles, particularly including co-operating lug features of bottles and their caps;

b. The prior art had knowledge of abutments, as in lock devices of various types and purposes;

c. The prior art had knowledge of ratcheting abutment members, permitting only one-way rotational relative movement;

d. The prior art had knowledge of cantilever beams, and knew of their properties;

e. The prior art had knowledge of plastics, and of integral formations involving molded plastic articles;

f. The prior art knew of the sealing effectiveness of camming effects by wedge-shaped tapers on relatively movable bodies;

g. The prior art knew of the desire for "chain of custody" preservation of specimens;

h. The prior art knew of the resilience and other properties of plastics;

i. The prior art knew of the principle of "resilient deformation" and its use in achieving a spring-back effect; and j. The prior art knew of rivet-type locking concepts.

Accordingly, the various concepts and components which are utilized and built upon in achieving the novel combination of the overall invention here are conceded and emphasized to have been widely known in the prior art in various uses, even of bottle and cap assemblies having safety characteristics; nevertheless, the prior art not having had the particular combination of concepts and details as here presented and shown as novel combinations different from the prior art and its suggestions, even only a fair amount of realistic humility, to avoid consideration of this overall invention improperly by hindsight, requires the concepts and achievement here to be realistically viewed as novel combinations, inventive in nature.

BRIEF DESCRIPTION OF THE DRAWINGS

The above description of the novel and advantageous lockable bottles, with ease of assembly and interlocking bottle and cap features, is of somewhat introductory and generalized form. More particular details, concepts, and features are set forth in the following and more detailed description of an illustrative embodiment, taken in conjunction with the accompanying drawings, which are of somewhat schematic and diagrammatic nature, for showing of the inventive concepts for such a lockable container combination whose concepts of the present invention are illustrated in this embodiment.

In the drawings:

FIG. 4 is a basic view of the assembly;

FIG. 5 shows the end portions of both cap nipples having been severed from the cap, although it is not to be inferred that both nipple-ends would likely ever be severed at the same time or the same procedure, this FIG. 5 being for drafting convenience to that extent;

FIG. 6 is a similar view, with both cap-nipples severed as in FIG. 5, for drafting convenience shown in the same view although not in an intended use, one cap-nipple receiving a plug as indicated by the pressure arrow, and one cap-nipple receiving a medicine dropper tool;

FIG. 7 shows the plug body of FIG. 6 lockingly inserted into the cap-nipple;

FIG. 8 shows the plug having been pushed or knocked fully through and out of the cap-nipple, and falling down into the bottle;

FIG. 9 is a top view of the bottle wall and of its abutment bodies;

FIG. 10 is a side elevational view thereof, looking at the outside of the bottle wall, FIGS. 11–14 are sequential schematic views of the assembly of the bottle and cap, of cross-sectional nature with foreground portions of the cap wall removed as to indicate the operativity of the abutment-bodies of the bottle and cap achieving the tightly sealed and locked condition; and more particularly:

FIG. 11 shows the bottle and cap held loosely adjacent one another, with the bottle about to be pushed upwardly, as per the direction arrows, toward the cap;

FIG. 12 shows the bottle's top edge now seated against the cap, and with cap-applying rotation of the bottle having been started as per the direction arrow;

FIG. 13 shows the flexible portions of the bottle lugs being cammed or ratcheted upwardly by abutment lugs of the cap, as the bottle has now been rotated a few more degrees as per the motion arrow; and FIG. 14 shows the assembly of cap and bottle now complete and locked, that is, with the bottle's top edge sealingly pressed against the cap by the camming or wedging effect of the co-operating lugs of the bottle and cap, and with the rotation having now been sufficient to let the lockable abutment walls pass one another and now be in locking confrontation, with the flexible portion of the bottle abutments now accommodated by a recess in each of the cap abutments.

DETAILED DESCRIPTION OF PREFERRED EMBODIMENT

Figure 2:
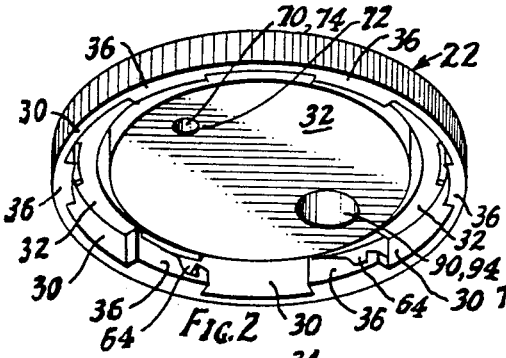
FIGS. 2 and 3 are isometric illustrations of the cap, generally showing the lug means just mentioned of the cap, although in these views showing the cap from opposite points of observation, FIG. 2 showing the underside, and FIG. 3 showing the cap from above, as the cap would appear prior to any attachment to a bottle, and prior to any bottle-opening procedures.
Figure 3:
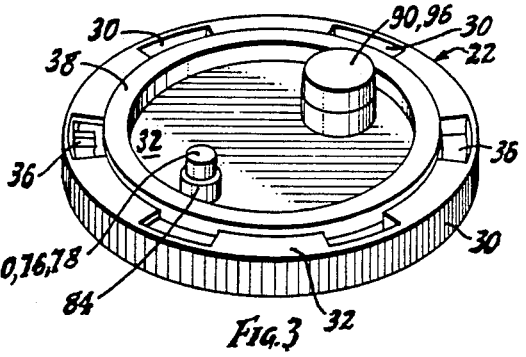
Figure 1:
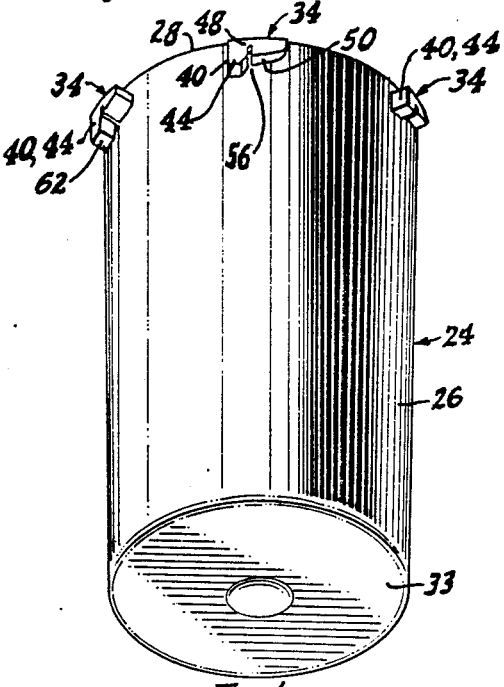
FIG. 1 is an isometric pictorial illustration of a bottle embodying the cap-locking lug means of the invention, which co-operate with lug means on the cap for cap-locking.
Figure 4:
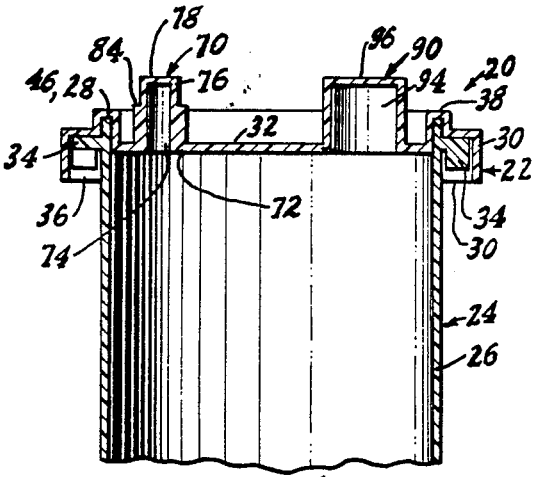
FIGS. 4–8 are vertical cross-sectional views, of fragmental nature, of a bottle and cap assembly, these views being sequential to only a limited extent; and more particularly.

As shown in the drawings, the concepts provide a tamper-proof bottle assembly 20, automatically locked against re-opening upon initial closure of its cap 22 onto the bottle 24 and with means for a one-time opening, with visual indication of it having been opened, and with automatically-locked means for re-sealing the bottle 24.

The bottle 24 is shown as having a cylindrical wall means 26 providing an outlet 28; and the cap 22 also is shown as having a cylindrical wall means 30, with a disc means 32 extending to the cylindrical wall means 30 of the cap means 22. The bottle 24's bottom wall is shown at 33.

The automatic locking of the cap 22 onto the bottle 24 is provided by two or more, preferably six in the form shown, sets of co-operating abutment body means, those lock-achieving sets respectively having an abutment body means 34 carried on the bottle 24's wall means 26 and an abutment body means 36 carried on the wall 30 of the cap means 22.

When the cap 22 is affixed onto the bottle 24, the engagement of the bottle's wall means 26 and the disc means 32 of the cap means 22 provides a sealed closing of the bottle outlet 28; but also co-operating with the abutment body means 34 and 36 and their placement on the bottle 24 and cap 22, the engagement of the bottle outlet 28 and the disc 32 (that engagement being shown in the form illustrated as in an annular cap-groove 38) provides an axial limiting abutment condition which limits how far the bottle 24 and cap means 22 may be moved axially into overlapping relationship during closure.

In contrast to so-called "child proof bottles" which have restricting or blocking means which require some special or "mature-mind" technique for releasing a cap from a bottle, thus useful particularly for medicine bottles, here the achievements are quite different, even though there is a superficial resemblance to such concepts.

More particularly, the present invention provides that there are abuttingly co-operative abutment walls 40 and 42 respectively on the abutment body means 34 of the bottle 24's wall means 26 and on the abutment body means 36 of the cap means 22; and those abutment walls 40/42 are operatively oppositely facing circumferentially (FIG. 14) when the cap means 22 is rotated onto and thus operatively affixed to the bottle 24's wall means 26 for closing the bottle outlet 28, as shown sequentially in FIGS. 11–14, thereby achieving a locking against reverse relative rotation of the cap 22 and bottle 24.

Figure 9:
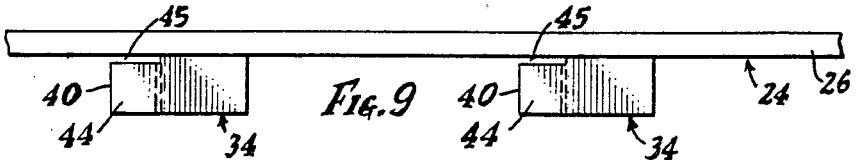
FIGS. 9–14 are "stretch out" views of fragmental nature, as a drafting convenience, for they are to illustrate the nature and effect of the co-operating abutment lug bodies of the bottle and cap rather than show details such as bottle wall curvature; and more particularly.
Figure 10:
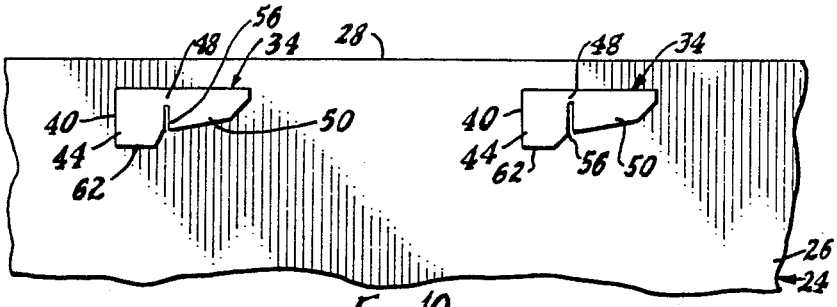
Figure 12:
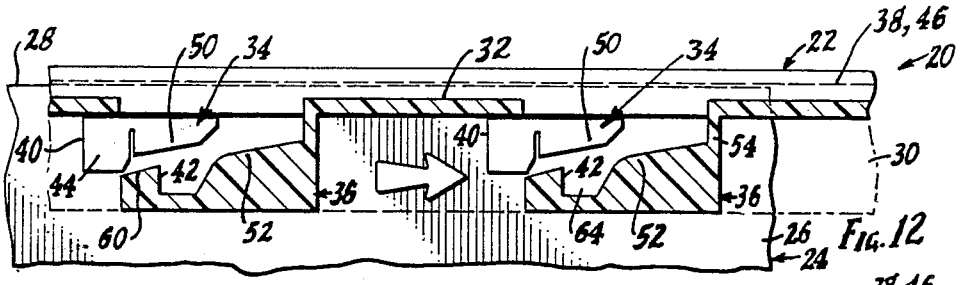
Figure 13:
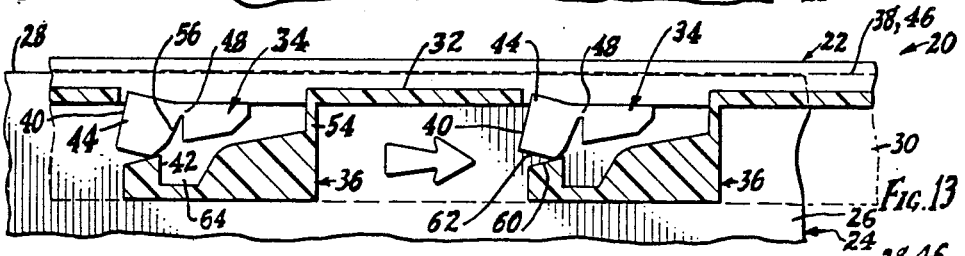

More particularly as best shown as to nature and operativity in FIG. 13 (and by comparing FIG. 13 with FIGS. 1, 10–12, and 14), it is to be noted that one of the abutment body means 34/36 of the bottle 24 and cap means 22 (here as shown it is the abutment body means 34 of the bottle 24) has a resiliently flexible extension portion 44 which is unconnected to the respective bottle 24 or cap means 24 (here the bottle 24) except through the respective abutment body means (here 34) by which the extension portion 44 is carried. (That non-connection of portion 44 of the abutment body means 34 to the bottle 24's wall 26 is perhaps best indicated by the non-connected nature shown by the slit 45, in FIG. 9, along the circumferential extent of each of the extension portions 44 along wall 26.)

Moreover, it is to be noted that the extension portion 44 (FIG. 13) is sufficiently flexible as to be forceable past the other abutment body means (here the other one is the cap abutment 36) as the bottle 24 and the cap means 22 are relatively rotated in a first or cap-locking relative rotation while the bottle 24 and the cap means 22 are then in their axial limiting abutment condition (FIGS. 12–14) in which the bottle 24's outlet rim 28 is pressed fully against the cap-disk means 32, here that being against the base or bottom 46 (top in the drawings) of the cap-groove 38.

It is to be further noted, as a factor of achieving the locked-cap operativity (FIG. 14) that the placement or relative position of the abutment body 34/36 relative to the bottle's outlet rim 28 and the base 46 of cap-groove 38 contributes to that cap-locking operativity, as well as to the tight cap-sealing operativity, as detailed herein.

Figure 14:
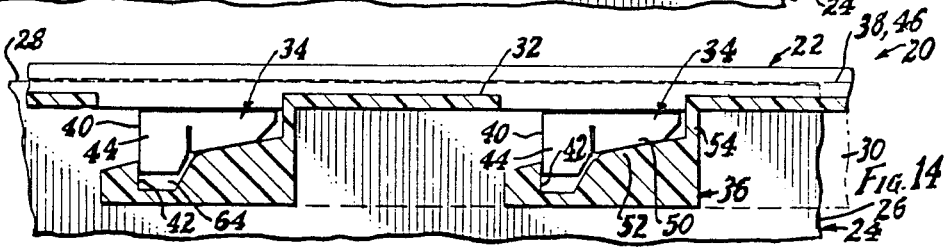

More particularly, the location of the abutment body means 34 and 36 of the bottle 24 and cap means 22, respectively, are such that without such flexibility the extension portion 44 would be blocked (FIG. 12) by the other abutment body means (here the other one is the cap abutment 36) so that the extension portion 44 could not pass, during that cap-locking rotation of the bottle 24 and cap means 22 in a first direction, the other abutment body means (here 36) sufficiently far enough circumferentially so as to let those abutment walls 40/42 pass circumferentially relative to one another to their cap-locking position of FIG. 14.

(It will be noted that the connection 48 of the extension portion 44 to its abutment body (here 34) is here considered a part of the extension portion 44, as indeed it is as to operativity of flexibility and resilient deformation, even though, in the form shown, it is integral with both the extension portion 44 and its abutment body (here 34). In another way of description, the extension portion 44 and its connection 48 may be said to be freely supported as a cantilever beam.)

Achieving the wall-passability of walls 40 and 42, the flexibility of the extension portion 44 is such as to permit the extension portion 44 of the abutment body (here 34) to move relatively axially to let the abutment walls 40/42 pass circumferentially relative to one another, when the bottle 24 and cap means 22 are relatively rotated in that first or cap-applying directions; but, even though that axial-movement flexibility is provided, and is achievable by a forceful rotation or twisting (FIGS. 12 and 13) of the bottle 24 and cap 22 relative to one another, it is also provided that the resilience of the extension portion 44 (including connection portion 48 as mentioned above) is such that after the walls' (40 and 42) passing of one another circumferentially by their relative axial movement during that relative rotation movement (FIGS. 12, 13) of the bottle 24 and cap means 22 in that first or cap-applying direction, the extension portion 44 will move or restore itself, by movement in the opposite relative axial direction (FIG. 14) to cause the two abutment walls 40/42 to then be operatively oppositely facing circumferentially as indicated in FIG. 14, thus blocking the bottle 24 and cap means 22 from being relatively rotated in the opposite or reverse direction, and thus operatively locking the bottle 24 and cap means 22 together, with the disc means 32 of the cap means 22 sealing the bottle's outlet 28 by the seal at 38/46.

The cap-locking is further assured by the abutment bodies 34 and 36 being of a size and position, respectively to the bottle outlet 28 and the cap-seal provision 38/46 (FIG. 14), that continued forceful twisting of the cap 22 and the bottle 24 in the first or cap-applying direction is blocked by the tight engagement of the engaging faces 50 and 52, respectively, of each of the bottle 24's abutment body 34 and the cap 22's abutment body 36 (FIG. 14); and even further assurance against further rotational movement in that first or cap applying direction is provided by a wall or lug 54 carried on wall 30 of the cap 22, between each cap abutment 36 and the cap's closure disk 32, blocking the path of the bottle abutment 34 against further twisting relative to the cap abutment 36.

It will be noted in the preferred form shown, that each of the abutment body means 34 and 36 are formed integrally with the wall 26 and wall 30 of the bottle 24 and cap 22, respectively, and the extra lugs or walls 54 of the cap 22 are members formed integrally with the cap 22's wall 30. The cap 22's transverse or closure disk 32 and its sealing ring 38/46 are also shown formed integrally with the wall 30 as an integral cap means 22 including the cap abutments 36; and, as to the bottle 24, its cylindrical wall 26 and its abutment body means 34 are provided as an integral member.

Both overall cap body means 22 and the overall bottle 24, each with its integral features as mentioned, are desirably formed of plastic, although not necessarily the same type of plastic.

With a consideration of the rigidity of the material, and the size, shape, and number of the extensions 44, and of their connection portions 48, the flexibility of the resiliently flexible portions 44 including their connection portions 48 is significantly provided in the form shown by the provision of a notch 56 shown as opening to the side of the connection portion 48 remote from the axial direction which the flexible extension portion 44 moves as described above to let the abutment walls 40/42 pass during relative rotation of the bottle 24 and cap means 22 in what is referred to herein as the first or cap-applying rotational direction. With the flexible extension portion 44 being on the abutment body means 34 of the bottle 24, the provision of the notch 56 opening is to the side 50 of the connection portion 48 remote from the bottle outlet 28.

Further as to the nature of the abutment bodies 34 and 36, it is noted that portions of the abutment body means 34/36 of at least one of the bottle 24 and cap means 22 (and here it is a wall-portion 60 of the cap's abutment body 36 rather than the corresponding wall-portion 62 of the extension member 44) is/are inclined (given an axial slant or taper) for providing a camming operativity (FIG. 13) for forcing the flexible extension portion 44 to move in the axial direction which the flexible extension portion 44 moves as described above to let the abutment walls 40/42 pass during relative rotation of the bottle 24 and cap means 22 in the first rotational direction giving cap-attaching operativity.

The tight engagement already mentioned as to the abutment body faces 50 and 52 is achieved by portions 50 or 52 of the abutment body means 34/36 of at least one of the bottle 24 and cap means 22 (here both the portions 50 and 52 of those bodies 34/36) being inclined (given an axial slant or taper), providing a camming operativity (similar to that mentioned for edges 60/62) during cap-affixing operativity, for forcing the bottle 24 and cap means 22 to a tightly sealed abutment condition (of 28 with 38/46) when the cap means 22 is operativly affixed to the bottle 24 and the abutment walls 40/42 have relatively passed one another and are oppositely facing, locking the bottle and cap means together as has been described.

Figure 11:
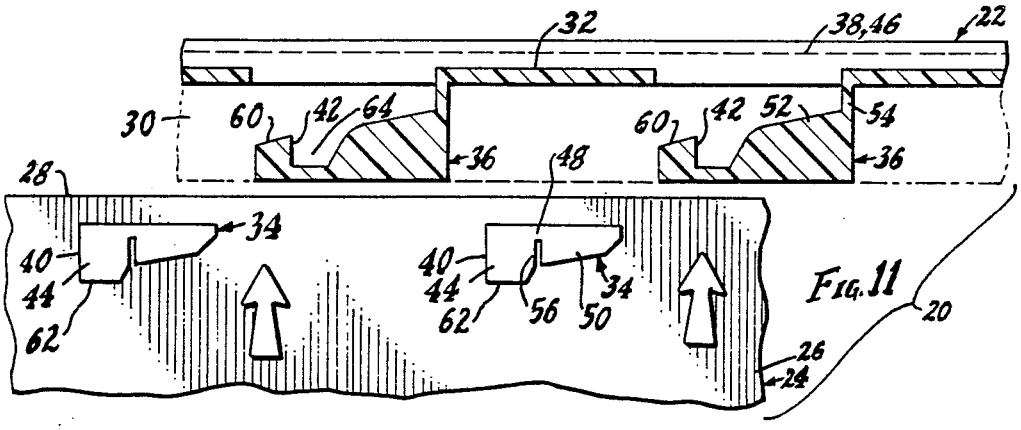

Ease of thrusting the bottle 24 and cap means 22 together, from the intermediate assembly relation shown in FIG. 11, to the subsequent and axially-limited assembly stage of FIG. 12 (which also shows a few degrees of relative twisting of the cap 22 onto the bottle 24), is achieved by providing all the sets of abutment body means 34/36 at equally-spaced intervals circumferentially of the respective cylindrical wall means 26 and 30.

The one of the abutment body means 34/36 (here 36) which does not carry the resiliently flexible extension portion 44 is provided with a recess 64 which opens (here upwardly) in the direction toward the path of the other abutment body means (here 34) when the cap 22 and the bottle 20 are being relatively rotated in affixing the cap means 22 to the bottle 24, and with the bottle outlet 28 and the cap 22 pressed together; and one circumferentially-facing wall (42) of that recess 64 is one of the locking walls (40/42) which co-operates to achieve the cap-locking effect with the other abutment wall (here 40), and the recess 64 extends longer circumferentially than is the circumferential extent of the extension portion 44. Thus, the recess 64 accommodates an entrance of the extension portion 44 into the recess 64 to permit the two abutment walls 40/42 to lockingly confront one another (FIG. 14) once those abutment walls have relatively passed one another during the affixing of the cap 22 to the bottle 24.

The "chain of custody" specimen-preservation factor is further provided by means now described, by which the bottle 24, although lockingly capped by the cap means 22, may be opened on a single occasion such as for testing, but re-sealed by an automatically lockable re-sealing means now described (FIGS. 2–8).

As shown, the cap 22's closure wall 32 is provided with a nipple 70; and providing a locked re-sealing operativity the nipple 70 is provided to have a shoulder 72 facing inwardly of the overall container means 20, the nipple 70 having a bore 74 extending to the shoulder face 72 which faces inwardly of the container means 20, the shoulder 72 being here shown as an integral portion of the cap's transverse wall 32; and it is to be noted that the nipple bore 74 inwardly of the shoulder 72 is open to or communicable with the interior of the container means 20.

Also, as shown, the nipple 70 also is shown provided at its outer end 76 with a closure means 76 which is removable, but which when once removed cannot be reinstalled into the nipple 70 without indication of its having been removed; and as shown, the closure means 76 is simply the nipple's end-portion 76 itself including its transverse sealing wall 78 which closes off the nipple 70's end portion 76.

There is also provided (FIGS. 6 and 7) a specially-configured plug body member 80 for plugging the nipple bore 74 after the closure means 76 has been removed.

It is to be noticed that the inner end 82 of the plug body member 80, i.e., the plug end 82 which when the plug body member 80 is plugged into the nipple 70 will be the plug body member end which is most inward of the container means 20, has a head 82 operatively larger than the nipple bore 74.

Insertion of the plug body 80 is accommodated by the head 82 being resiliently deformable, permitting the plug body member 80 to be forced to enter the bore 74's outer end 84 to pass inwardly through the nipple bore 74 as far as past the shoulder 72. This is accommodated by the deformability of the plug-head 82 even though without such deformation the head 82 would be too large to enter and to pass through the nipple bore 74.

Cam means, here the slope of the walls of the inner plug-end 82, are provided and operative between the plug body member head 82 and the exterior portion 84 of the nipple, providing that the plug body member head 82 will be deformed, such that it may be forced to enter the nipple bore 74, after the nipple's closure means 76 has been removed (FIG. 6), by the user pushing on the plug body member 80 in a direction axially of the nipple bore 74 and with the plug body member's head 82 against the exterior portion 84 of the nipple 70.

The resilience of the plug body member 80's head 82 is such that, when the plug body member 80 is forced into and through the nipple 74 far enough that the plug body member head 82 is inwardly past the shoulder 72, the head's resilience will urge it to return to undeformed condition (FIG. 7) such that it is then too large to be withdrawn outwardly through the shoulder 72.

The lockability thus achieved for the plug body 80 in the bore 74, as thus attained, is assured by the factors of the inwardly-facing face 72 of the nipple shoulder 72 and the plug body member head 22 being devoid of any cam means which would be operative to deform the plug body member head 80 oppositely, i.e., which would permit it to pass outwardly through the shoulder 72.

Thus, it will be seen that the plug body member 80, once it is inserted into the nipple bore 74 far enough to pass the shoulder 72, is blocked from being withdrawn outwardly past the shoulder 72, by the abutting engagement of the plug body member head 82 and the shoulder 72.

Economy is made likely by the plug body member head 82 being formed as an integral portion of the plug body member 80 itself.

Further, the economy by integralness of the head 82 and plug body 80 is shown as supplemented by the provision of a recess 86 in the plug body member head 82, the recess 86 permitting portions of the plug body member head 82 which are adjacent the recess 86 to be deformed into the space of the recess 86, thus contributing deformability for the size-lessening operativity as mentioned, yet permitting the resiliency or spring-back to the large-head condition (FIG. 7) which locks the plug 80 in the nipple bore 74.

With the re-sealing feature just described (FIGS. 4–8), as an illustrative use or procedure, the container 20's original specimen may be easily reached by snipping off the nipple 70's end 76/78, removal of a sample outwardly through the bore 74, then re-sealed by forcing the plug 80 (FIGS. 6, 7) into its locked position, it being a tight fit for good sealing.

Any subsequent re-opening of nipple 70, as by forcing the plug 80 (FIG. 8) on through the bore 74 and into the bottle 24, is easily accomplished; and even if that re-opening would try to be masked by the provision of another plug body into the bore 74, the presence of the original re-sealing plug 80 in the bottle 24 is a visible indication of tampering.

Figure 5:
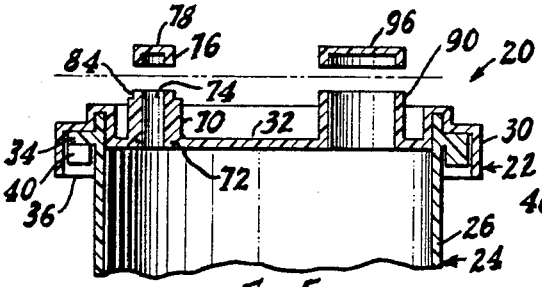
Figure 6:
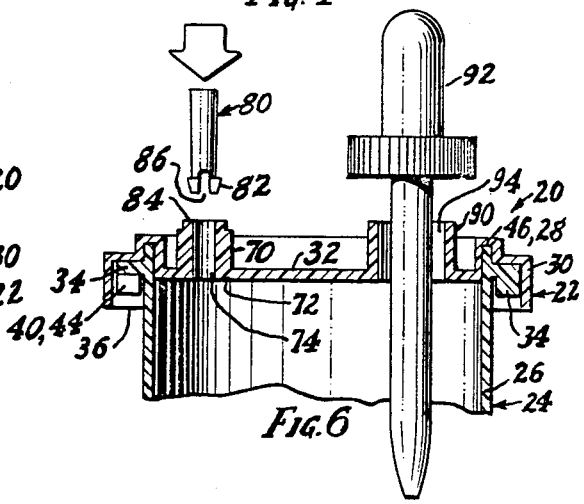
Figure 7:
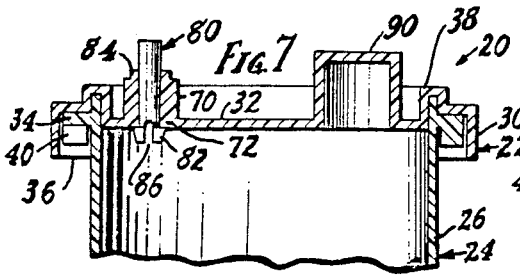
Figure 8:
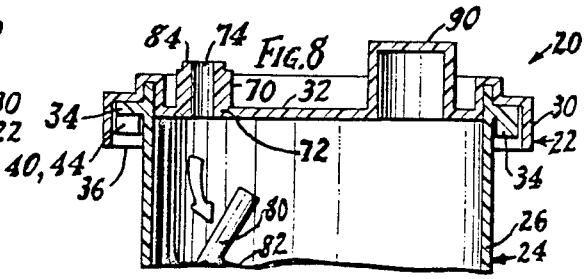

An additional nipple 90 is desirably provided in a size considerably larger than nipple 70, for ease of contents-withdrawal, and this is illustrated in FIG. 6 in a procedure of specimen-removal by a medicine dropper 92 inserted into and through the nipple bore 94 after that nipple 90's end or closure wall 96 has been snipped off (FIG. 5); although it is to be noted that each of FIGS. 5 and 6 is of a composite nature by a draftsman's conventon, rather than any container assembly 20 ever likely being opened as to both nipples 70 and 90 at the same time as there diagrammatically shown.

BRIEF OPERATIONAL SUMMARY

The specimen to be presented is placed into the bottle 24; and it is then kept tamperproof by affixing the cap means 22 as sequentially shown in FIGS. 11–14, in which the forced passage of the abutment walls 40/42 past one another, and with the resilient deformation of extension 44 then pushing it into the recess 64, the cap 22 will have been affixed or locked to the bottle 24 with the cap 22 blocked by the abutment of walls 40/42 from being removed without breakage of the bottle or the cap, with visual signs of the tampering.

For testing of a sample portion of the specimen, or other authorized reasons, the once-operable removability means of the nipple 70 and plug 80 provides that even though the cap 22 has been locked to the bottle, the bottle may be opened once, but the plug provides a locked or non-removable closure means preventing further opening, the concepts in their combination thus effectively providing that a substance put into the bottle 24 is preservably tamper-proof thereafter except on a single occasion, for "chain of custody" proof as to the unalterred status of the specimen being preserved.

CONCLUSION

It is thus seen that a tamperproof container, having a series of co-operating abutments of a special formation on the lid and the bottle, and constructed and used according to the inventive concepts herein set forth, provides novel concepts of a desirable and advbatageous device, yielding the advantages of a tamperproof container which provides ease of proper assembly yet positive locking features, conceptually different from the prior art even though safety containers having special interconnectability as a basic concept have of course been known for years; yet significantly this particular combination of prior art has not been suggested by the prior art, this achievement being a substantial and advantageous departure from prior art, even though the prior art shows various types of "hard to open" containers for many years. And particularly is the overall difference from the prior art significant when the non-obviousness is viewed by a consideration of the subject matter as a whole, as integrally building on prior art yet incorporating features and concepts different from the prior art, in contrast to merely these details of novelty themselves, and further in view of the prior art's type of safety containers teaching away from the particular and inter-related concepts and features of the present invention, achieving lockability.

In summary as to the nature of these advantageous concepts, their inventiveness is shown by novel features of concept and construction shown here, in novel and advantageous combination, not only being different from all the prior art known, but because the achievement is not what it is or has been suggested to those of ordinary skill in the art, especially considering this as comprising components and features which except in the present combination may be considered to be similar in nature to what is well known to most persons, surely including most of the many makers and users of most "safety containers," "child-proof containers," etc., for may years, the entire world over. No prior art has suggested the modifications of any prior art to achieve the particular novel concepts here achieved in the combination of this invention, with the various features providing ease of assembly yet automatic and positive locking for confident tamperproofing yet providing also a "once openable" feature without disturbing the locked condition.

Accordingly, it will thus been seen from the foregoing description of the invention according to this illustrative embodiment, considered with the accompanying drawings, that the present invention provides new and useful concepts of a novel and advantageous tamperproof bottle having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiment, or form or arrangement of parts herein described or shown.

I claim:

1. A tamper-proof bottle having a cylindrical wall means providing an outlet, and a cap means also having a cylindrical wall means and a disc means extending to the cylindrical wall means of the cap means, there being two or more abutment body means sets respectively having abutment body means respectively carried on portions of the bottle's wall means and the cap means, the engagement of the bottle's wall means and the disc means of the cap means providing a closing of the bottle outlet and also an axial limiting abutment condition which limits how far the bottle and cap means may be moved axially into overlapping relationship, the improvement for such a bottle and cap means comprising the provision of abutment walls on both the abutment body means of the bottle's wall means and of the cap means, said abutment walls being operatively oppositely facing circumferentially when the cap means is operatively affixed to the bottle as herein set forth for closing the bottle outlet, one of the said abutment body means of the bottle and cap means having a resiliently flexible extension portion which is unconnected to the respective bottle or cap means except through the respective abutment body means by which the extension portion is carried, and is sufficiently flexible as to be forceable past the other abutment body means as the bottle and cap means are relatively rotated while the bottle and the cap means are then in said axial limiting abutment condition, the location of the abutment body means of the bottle and cap means being such that without such flexibility the extension portion would be blocked by the other abutment body means so that the extension portion could not pass, during a rotation of the bottle and cap means in a first direction, the said other abutment body means sufficiently circumferentially as to let the abutment walls pass circumferentially relative to one another, the flexibility of the extension portion being such as to permit the extension portion to move relatively axially to let the abutment walls pass circumferentially relative to one another, when the bottle and cap means are relatively rotated in that first direction;

and the resilience of the extension portion being such that after passing one another circumferentially by their relative axial movement, during relative rotation movement of the bottle and cap means in that first direction, the extension portion will move in the opposite relative axial direction to cause the two abutment walls to then be operatively oppositely facing circumferentially as aforesaid, thus blocking the bottle and cap means from being relatively rotated in the opposite direction, thus operatively locking the bottle and cap means together with the disc means of the cap means sealing the bottle's outlet.

2. The invention as set forth in claim 1, in a combination in which it is the abutment body means of the bottle which is provided with the said resiliently flexible extension portion.

3. The invention as set forth in claim 1, in a combination in which the connection of the extension portion to the abutment body means which carries the extension portion is a portion of the extension portion.

4. The invention as set forth in claim 1, in a combination in which the abutment body means which has the resiliently flexible extension portion, and the said resiliently flexible extension portion, including its connection to the said abutment body means, is an integral member.

5. The invention as set forth in claim 1, in a combination in which the abutment body means which has the resiliently flexible extension portion, and the said resilienty flexible extension portion, including its connection to the said abutment body means, is an integral member, and is formed integrally with the cylindrical wall of whichever it is of the bottle or cap means which carries the abutment body means having the resiliently flexible extension member.

6. The invention as set forth in claim 1, in a combination in which the flexibility of the resiliently flexible portion is significantly provided by the provision of a notch opening to the side of the connection portion remote from the axial direction the flexible extension portion moves as aforesaid to let the abutment walls pass during relative rotation of the bottle and cap means in said first rotational direction.

7. The invention as set forth in claim 1, in a combination in which the flexibility of the resiliently flexible portion is significantly provided by the provision of a notch opening to the side of the connection portion remote from the bottle outlet.

8. The invention as set forth in claim 1, in a combination in which portions of the abutment body means of at least one of the bottle and cap means are inclined for providing a camming operativity for forcing the flexible extension portion to move in the axial direction the flexible extension portion moves as aforesaid to let the abutment walls pass during relative rotation of the bottle and cap means in said first rotational direction.

9. The invention as set forth in claim 1, in a combination in which the one of the abutment body means which does not carry the said resiliently flexible extension portion is provided with a recess which opens in the direction toward the path of the other abutment body means when the cap means and the bottle are being relatively rotated in the procedure of affixing the cap means to the bottle, and with the bottle outlet and the cap means pressed together, one circumferentially-facing wall of which recess is one of the said abutment walls which co-operates, to achieve cap-means locking, with an abutment wall of the abutment body means which does carry the said resiliently flexible extension portion, and the said recess extends longer circumferentially than is the circumferential extent of the extension portion, thus accommodating an entrance of the extension portion into the recess, to permit the two said abutment walls to lockingly confront one another once those abutment walls have relatively passed one another in the operative affixing of the cap means to the bottle as aforesaid.

10. The invention as set forth in claim 1, in a combination in which portions of the abutment body means of at least one of the bottle and cap means are inclined for providing a camming operativity for forcing the bottle and cap means to a tightly sealed abutment condition when the cap means is operatively affixed to the bottle and the abutment walls have relatively passed one another and are oppositely facing, locking the bottle and cap means together as aforesaid.

11. The invention as set forth in claim 1, in a combination in which portions of the abutment body means of both of the bottle and cap means are inclined for providing a camming operativity for forcing the bottle and cap means to a tightly sealed abutment condition when the cap means is operatively affixed to the bottle and the abutment walls have relatively passed one another and are oppositely facing, locking the bottle and cap means together as aforesaid.

12. The invention as set forth in claim 1, in a combination in which the flexibility of the resiliently flexible portion is significantly provided by the flexible extension portion being unconnected to the cylindrical wall of the cap means or bottle through whose abutment body means it is supported, even though disposed alongside said cylindrical wall, and thus being supported only in a cantilever manner by the said abutment body means.

13. The invention as set forth in claim 6, in a combination in which the flexibility of the resiliently flexible portion is significantly provided by the flexible extension portion being unconnected to the cylindrical wall of the cap means or bottle through whose abutment body means it is supported, even though disposed alongside said cylindrical wall, and thus being supported only in a cantilever manner by the said abutment body means.

14. The invention as set forth in claim 1, in a combination in which the sets of abutment body means are provided at equally-spaced intervals circumferentially of the cylindrical wall means which carries them.

15. The invention as set forth in claim 14, in a combination in which there are at least three of said sets.

16. The invention as set forth in claim 14, in a combination in which there are at least four of said sets.

17. The invention as set forth in claim 14, in a combination in which there are six of said sets.

18. A tamper-proof container means having a closure wall which is provided with a nipple, the nipple having a shoulder facing inwardly of the container means, and having a bore extending to the shoulder face which faces inwardly of the container means, the bore inwardly of the said shoulder being communicable with the interior of the container means, the nipple also being provided at its outer end with a closure means which is removable but which when once removed cannot be reinstalled into the nipple without indication of its having been removed, and a plug body member for plugging the bore after the closure means has been removed, the end of the plug body member, which when the plug body member is pluggingly installed into the nipple will be the plug body member end which is most inward of the container means, having a head operatively larger than the nipple bore, but the head being resiliently deformable, the deformability of the plug body member head being such as to permit the plug body member to be forced to enter the bore end and to pass inwardly through the nipple bore, as far as past the said shoulder, even though without such deformation it would be too large to so enter and so pass, there being cam means provided and operative between the plug body member head and the exterior portion of the nipple, providing that the plug body member head will be deformed, such that it may be forced to enter the nipple bore, after the closure means has been removed, by pushing on the plug body member in a direction axially of the nipple bore, and with the plug body member's head against the exterior portion of the nipple, and the resilience of the plug body member head being such that, when the plug body member is forced into and through the nipple far enough that the plug body member head is inwardly past the shoulder, the head's resilience will urge it to return to undeformed condition such that it is then too large to be withdrawn outwardly through the shoulder, the inwardly-facing face of the said shoulder and the said plug body member head being devoid of any cam means which would be operative to deform the plug body member head to permit it to pass outwardly through the said shoulder, thereby the plug body member, once it is inserted into the nipple bore far enough to pass the said shoulder, is blocked from being withdrawn outwardly past the said shoulder, by the abutting engagement of the plug body member head and said shoulder.

19. The invention as set forth in claim 18, in a combination in which the plug body member head is formed as an integral portion of the plug body member.

20. The invention as set forth in claim 18, in a combination in which there is provided a recess in the plug body member head, which permits portions of the plug body member head which are adjacent said recess to be deformed into the space of said recess, thus contributing deformability for operativity as aforesaid.

21. The invention as set forth in claim 19, in a combination in which there is provided a recess in the plug body member head, which permits portions of the plug body member head which are adjacent said recess to be deformed into the space of said recess, thus contributing deformability for operativity as aforesaid.

22. The invention as set forth in claim 18, in a combination in which the shoulder is provided as a portion of the closure wall with which the nipple is provided.

23. The invention as set forth in claim 21, in a combination in which the shoulder is provided as a portion of the closure wall with which the nipple is provided.

24. The invention as set forth in claim 18, in a combination in which the removable closure means is provided integrally with the nipple, as an integral exterior portion of the nipple and a transverse closure wall of the nipple.

25. The invention as set forth in claim 19, in a combination in which the removable closure means is provided integrally with the nipple, as an integral exterior portion of the nipple and a transverse closure wall of the nipple.

* * * * *